US011764462B2

(12) United States Patent
Lin

(10) Patent No.: US 11,764,462 B2
(45) Date of Patent: Sep. 19, 2023

(54) VEHICLE DOOR HANDLE

(71) Applicant: BCS ACCESS SYSTEMS US, LLC, Wilmington, DE (US)

(72) Inventor: Xing Ping Lin, West Bloomfield, MI (US)

(73) Assignee: BCS ACCESS SYSTEMS US, LLC, Wilmington, DE (US)

( * ) Notice: Subject to any disclaimer, the term of this patent is extended or adjusted under 35 U.S.C. 154(b) by 360 days.

(21) Appl. No.: 16/990,006

(22) Filed: Aug. 11, 2020

(65) Prior Publication Data

US 2022/0052446 A1 Feb. 17, 2022

(51) Int. Cl.

| | |
|---|---|
| ***H01Q 1/32*** | (2006.01) |
| ***H01Q 5/40*** | (2015.01) |
| ***H01Q 7/08*** | (2006.01) |
| ***H01Q 21/28*** | (2006.01) |

(52) U.S. Cl.
CPC ..... *H01Q 1/3241* (2013.01); *H01Q 1/3283* (2013.01); *H01Q 5/40* (2015.01); *H01Q 7/08* (2013.01); *H01Q 21/28* (2013.01)

(58) Field of Classification Search
CPC ..... H01Q 1/3241; H01Q 1/3283; H01Q 5/40; H01Q 21/28; H05B 81/78
See application file for complete search history.

(56) References Cited

U.S. PATENT DOCUMENTS 6,163,305 A * 12/2000 Murakami ..... H01Q 21/24 343/788
6,664,936 B2 * 12/2003 Ieda ..... E05B 81/78 343/866
9,147,148 B2 * 9/2015 Ziller ..... G07C 9/00944
10,403,979 B2 * 9/2019 Ryu ..... H01Q 7/00
10,505,257 B2 * 12/2019 Orihara ..... H01Q 1/243
10,511,089 B2 * 12/2019 Ito ..... H04B 5/0031
10,516,208 B2 * 12/2019 Lee ..... H01Q 1/526
10,707,565 B2 * 7/2020 Navarro Pérez ..... H01Q 1/523
11,444,378 B2 * 9/2022 Canete Cabeza .... H01Q 1/3241
2003/0122725 A1 * 7/2003 Ieda ..... H01Q 21/28 343/788
2005/0237220 A1 * 10/2005 Nolan ..... G07C 9/00309 340/12.34
2007/0247387 A1 * 10/2007 Kubo ..... H01Q 7/08 340/572.7
2013/0341414 A1 * 12/2013 Ziller ..... H01Q 5/40 235/492
2014/0035793 A1 * 2/2014 Kato ..... H01Q 7/06 343/867
2014/0176382 A1 * 6/2014 Nakano ..... G06K 7/10178 343/788

(Continued)

FOREIGN PATENT DOCUMENTS

DE 102014104235 A1 10/2015

*Primary Examiner* — Ab Salam Alkassim, Jr.

(74) *Attorney, Agent, or Firm* — McNees Wallace & Nurick LLC

(57) ABSTRACT

A vehicle door handle for a motor vehicle is described, which includes an integrated transmitting and/or receiving device which comprises an LF antenna and a separately formed NFC antenna. The NFC antenna has a plurality of windings provided on a circuit board. The LF antenna has a plurality of coils wound around a core material formed separately from the circuit board. The NFC antenna encompasses a projection of the LF antenna on the circuit board.

15 Claims, 3 Drawing Sheets

(56) References Cited

U.S. PATENT DOCUMENTS

| | | | | |
|---|---|---|---|---|
| 2017/0050615 | A1* | 2/2017 | Schindler | B60R 25/24 |
| 2017/0050616 | A1* | 2/2017 | Liubakka | H01Q 1/2291 |
| 2017/0263066 | A1* | 9/2017 | Kang | G07C 9/00896 |
| 2018/0374294 | A1* | 12/2018 | Farges | H01Q 1/3241 |
| 2019/0020379 | A1* | 1/2019 | Zhao | H01Q 1/38 |
| 2020/0047712 | A1* | 2/2020 | Spick | H04B 5/0081 |
| 2020/0160635 | A1* | 5/2020 | Koizumi | E05B 85/16 |
| 2021/0102415 | A1* | 4/2021 | Scheibe | E05B 81/78 |
| 2022/0176897 | A1* | 6/2022 | Sieg | H01Q 1/3283 |
| 2023/0066901 | A1* | 3/2023 | Kosugi | H01Q 1/3241 |

* cited by examiner

- state of the art -

- state of the art -

VEHICLE DOOR HANDLE

FIELD OF THE DISCLOSURE

The present disclosure relates to a vehicle door handle for a motor vehicle.

BACKGROUND

In the state of the art, vehicle door handles for a motor vehicle are known, which comprise a near field communication (NFC) device that is used as an access tool. Near field communication technologies relate to a pair of devices associated with two sides. One side is associated with a reader which often requires a high power for transmission. The other side is a tag, particularly a passive tag that does not require any power or that has low power consumption. The operation range of the near field communication technology operating at frequencies of about 13.56 MHz is typically short and therefore secure.

In the automotive sector, a near field communication reader and an antenna associated therewith are provided inside a door handle. A driver can use its cellphone having NFC functionality or a separately formed NFC card as NFC tag in order to access the vehicle when placing the cellphone or rather NFC card over the door handle in a proximity, as the NFC reader senses the NFC tag. The NFC reader identifies the NFC tag as a registered one such that entry permission is granted.

In addition, motor vehicles also have a passive entry system that uses low frequency (LF) communication technologies as well as higher frequency technologies, namely radio frequency (RF) technologies. The low frequency may relate to 125 kHz, whereas the radio frequency is about 315 MHz, 434 MHz or rather 2.4 GHz in case of Bluetooth technologies. Usually, the motor vehicle has a low frequency transmitter and a radio frequency receiver which interact with a key fob that can be carried by a driver. Once the driver with a paired key fob approaches the motor vehicle, the low frequency antenna associated with the motor vehicle will send a command to the low frequency receiver in the key fob, thereby causing the key fob to respond to the command by sending a radio frequency signal back to the motor vehicle. The radio frequency receiver within the motor vehicle receives the radio frequency transmission of the key fob and verifies an identification. When a match has been identified, entry permission is granted.

In the state of the art, the low frequency antenna associated with the vehicle is also typically placed in the door handle. However, the door handle has limited space, thereby affecting both communication technologies, namely the near field communication technology as well as the low frequency technology. The antenna arrangements used so far in the state of the art result in impairments of the overall performance of both antennas, namely the local frequency antenna and the near field communication antenna, thereby reducing the operation distance of at least one of both antennas.

Accordingly, there is a need for a vehicle door handle that provides both functionalities without any impairment of the respective performances.

SUMMARY

The present disclosure provides a vehicle door handle for a motor vehicle. The vehicle door handle includes an integrated transmitting and/or receiving device that comprises a low frequency (LF) antenna and a separately formed near field communication (NFC) antenna. The NFC antenna has a plurality of windings provided on a circuit board. The LF antenna has a plurality of coils wound around a coil material formed separately from the circuit board. The NFC antenna encompasses a projection of the LF antenna on the circuit board.

Accordingly, two separate antennas are provided, namely the low frequency (LF) antenna and the near field communication (NFC) antenna, which together establish the integrated transmitting and/or receiving device accommodated in the vehicle door handle. The LF antenna has several coils that are wound around the coil material that is different to the circuit board on which the plurality of windings of the NFC antenna are provided. In fact, the windings are located on a main plane of the circuit board, which may face towards the LF antenna. Accordingly, the NFC antenna and the LF antenna are formed separately with respect to each other, as they do not share a common support member.

Furthermore, the NFC antenna encompasses a projection of the LF antenna on the circuit board. Put differently, a top view on the circuit board results in an arrangement in which the LF antenna is encompassed laterally by the NFC antenna. Accordingly, the NFC antenna is longer and wider than the LF antenna such that the projection of the LF antenna on the circuit board is surrounded by the NFC antenna, particularly its windings, within a respective plane, particularly the main plane of the circuit board.

This respective antenna arrangement ensures that the NFC antenna has a large operation area compared to a side-by-side arrangement of the antennas, in which the operation area of the NFC antenna is typically reduced.

An aspect provides that the LF antenna and the NFC antenna are arranged one above the other with respect to the printed circuit board. Accordingly, the respective antennas are arranged with respect to each other in a sandwiched manner. In fact, the NFC antenna and the LF antenna are spaced from each other in a direction perpendicular to the main plane of the circuit board.

For instance, the LF antenna and the NFC antenna are stacked on top of each other. Hence, a stacked arrangement is provided. The LF antenna may be placed on the circuit board such that the LF antenna contacts the main plane of the circuit board on which the windings of the NFC antenna are located. However, the NFC antenna and the LF antenna do not share a common support or rater material portion, resulting in separate antennas that are stacked together in order to reduce the installation space required.

Another aspect provides that the NFC antenna and the circuit board together form a module formed in one-piece. Put differently, the NFC antenna is integrated within the circuit board. For instance, the windings of the NFC antenna are printed on the circuit board, thereby ensuring that the respective module is formed integrally.

As already mentioned above, the LF antenna may be placed on the separately formed NFC antenna. For instance, the LF antenna is a typical LF antenna that is additionally placed on the NFC antenna printed on the circuit board.

Thus, the LF antenna may be placed on the separately formed module. Accordingly, the antenna arrangement of the vehicle door handle may comprise two separately formed parts, namely the module as well as the LF antenna, wherein both parts are placed on each other, thereby establishing the antenna arrangement, namely the antenna stack.

The LF antenna may be assigned to a center of the NFC antenna. This ensures that the radiation pattern of the NFC antenna, also called NFC field, is disturbed minimally by the LF antenna.

Particularly, the LF antenna is assigned to a center axis of the windings of the NFC antenna. The windings of the NFC antenna run parallel to the main plane of the circuit board such that the center axis of the windings is perpendicular to the main plane of the circuit board.

According to another aspect, the LF antenna and the NFC antenna are arranged perpendicular to each other. Hence, the respective field lines of the antennas run into perpendicular directions, thereby ensuring that the respective fields of the antennas disturb each other minimally as coupling effects are minimized. Accordingly, the overall performance of the antenna arrangement associated with the vehicle door handle is maximized.

Hence, field lines of a LF field associated with the LF antenna and field lines of a NFC field associated with the NFC antenna may intersect each other perpendicularly. Since the respective antennas are orientated perpendicular to each other, their respective field lines also intersect each other in a perpendicular manner, thereby reducing any coupling of the respective fields or rather antennas.

Another aspect provides that the NFC antenna provides a NFC field that covers an area that is associated with the dimensions of the vehicle door handle. Thus, the operative area of the NFC antenna is maximized since the dimensions of the NFC field associated with the NFC antenna corresponds to the entire vehicle door handle. In comparison to a side-by-side arrangement of the antennas, the operative area of the NFC antenna is enlarged significantly. This improves the usability of the entire transmitting and/or receiving device since the driver is not required to search for the NFC antenna within the vehicle door handle.

Particularly, the LF antenna is located in the NFC field of the NFC antenna, wherein the field lines associated with the NFC field bend over the LF antenna. This ensures that the LF antenna does not completely block the NFC field provided by the NFC antenna. In fact, the NFC field, namely the field lines of the NFC field, follow the contour of the LF antenna. The entire NFC field, namely the field lines running along the contour of the LF antenna, bend over the LF antenna, thereby establishing a continuous NFC field facing away from the vehicle door handle. Accordingly, the driver is also enabled to use the NFC functionality while interacting with a portion of the vehicle door handle at which the LF antenna is located, as the NFC fields bend along the contour.

Even though a strength of the NFC field may be reduced by the LF antenna (in a minimal manner), the NFC antenna provides a continuous operative NFC field. Accordingly, the overall performance of the antenna arrangement is ensured.

In fact, the NFC field has a substantially homogenous strength distribution along a length side of the vehicle door handle. Therefore, a driver of the motor vehicle does not realize that the LF antenna is placed in front of the NFC antenna since no blind spots of the NFC field occur due to a blocking by means of the LF antenna.

Generally, the length side of the vehicle door handle corresponds to the long side of the NFC antenna.

Moreover, the radiation pattern of the NFC antenna is only disturbed in such a manner, resulting in a homogeneous NFC field.

In fact, the NFC antenna may extend over the entire circuit board, thereby maximizing the operational area available. The dimensions of the circuit board may correspond to the interior space within the vehicle door handle.

In general, the LF antenna is placed in the middle of the NFC antenna, wherein the dimensions of the NFC antenna are increased with regard to its length and width. This ensures best NFC field coverage since the NFC antenna covers an area that corresponds to the dimensions of the vehicle door handle, thereby providing a maximized surface coverage.

The NFC antenna performance is maximized since the entire circuit board is utilized for providing the NFC antenna.

In addition, the antenna arrangement provided is established by two separately formed antennas, namely the LF antenna having the plurality of coils wound around the coil material, for instance air or a ferrite material. However, the coils of the LF antenna are not wound around the circuit board that provides the windings of the NFC antenna. This already makes clear that the NFC antenna and the LF antenna are formed separately.

Since the NFC antenna is increased with respect to its dimensions, it is ensured that both ends of the NFC antenna emit signals. In fact, all edges of the NFC antenna, namely the windings of the NFC antenna, are not covered by the LF antenna such that they contribute to the overall performance of the NFC antenna. This can be ensured by placing the LF antenna on top of the center of the NFC antenna, which is maximally distanced from the respective edges of the NFC antenna.

BRIEF DESCRIPTION OF THE DRAWINGS

The foregoing aspects and many of the attended advantages of the claimed subject matter will become more readily appreciated as the same become better understood by reference to the following detailed description when taken in conjunction with the accompanying drawings. In the drawings, FIG. 1 schematically shows a vehicle door handle according to the present disclosure, FIG. 2 schematically shows the vehicle door handle of FIG. 1 in operation.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed. For the purposes of the present disclosure, the phrase "at least one of A, B, and C", for example, means (A), (B), (C), (A and B), (A and C), (B and C), or (A, B, and C), including all further possible permutations when greater than three elements are listed. In other words, the term "at least one of A and B" generally means "A and/or B", namely "A" alone, "B" alone or "A and B".

Figure 1:
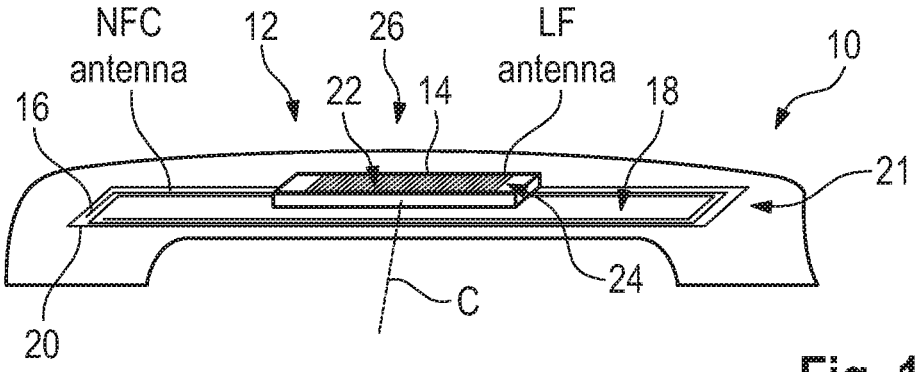

In FIG. 1, a vehicle door handle 10 is shown that is used in a motor vehicle.

The vehicle door handle 10 includes an integrated transmitting and/or receiving device 12 that comprises a low frequency (LF) antenna 14, a separately formed near field communication (NFC) antenna 16 as well as a circuit board 18.

The NFC antenna 16 has a plurality of windings 20 that are provided on the circuit board 18, particularly a main plane of the circuit board 18 facing towards the LF antenna 14. In fact, the NFC antenna 16 is printed on the circuit board 18. Since the NFC antenna at the circuit board 18 are formed integrally with each other, they together form a module 21 formed in one-piece.

In addition, the LF antenna 14 has a plurality of coils 22 that are wound around a coil material 24 that is formed separately from the circuit board 18, for instance by air or a ferrite.

Accordingly, the LF antenna 14 is separately formed with respect to the NFC antenna 16 since they do not share a common support material. In fact, the antennas 14, 16 are only located in proximity of each other, thereby providing an antenna arrangement 26.

In fact, the LF antenna 14 and the NFC antenna 16 are separately formed with respect to each other, but the antennas 14, 16 are arranged one above the other with respect to the printed circuit board 18, thereby establishing a stacked antenna arrangement 26 (antenna stack) since the LF antenna 14 is placed on top of the NFC antenna 16, particularly the module 21.

As shown in FIG. 1, the LF antenna 14 is assigned to a center C of the NFC antenna 16, particularly a center axis of the windings 20 of the NFC antenna 16, which is perpendicular to the main plane of the circuit board 18.

Accordingly, the edges of the NFC antenna 16 are not covered by the LF antenna 14 that is located on top of the center C of the NFC antenna 16, thereby ensuring that the operation coverage of the NFC antenna 16 is large. Particularly, the NFC operation coverage corresponds to the dimensions of the vehicle door handle 10.

In other words, the NFC antenna 16 encompasses a projection of the LF antenna 14 on the circuit board 18 since the edges of the NFC antenna 16 surround a projection of the LF antenna 14 on the circuit board 18 laterally. Accordingly, the LF antenna 14 is encompassed by the NFC antenna 16, particularly its edges, in a top view on the circuit board 18. Hence, the NFC antenna 16 is longer and wider than the separately formed LF antenna 14.

Figure 2:
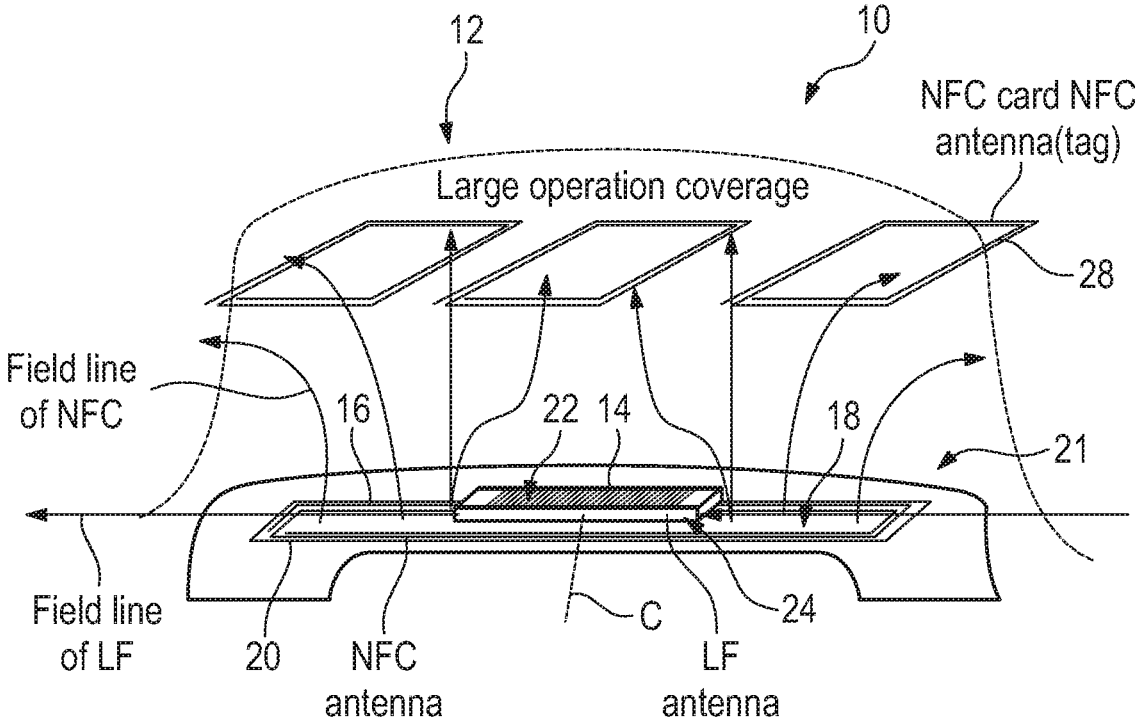

The respective antennas 14, 16 are arranged perpendicular to each other as shown in FIG. 2 in which the operation of the integrated transmitting and/or receiving device 12 is illustrated.

In fact, field lines associated with the respective antennas 14, 16 intersect each other perpendicularly since the respective antennas 14, 16 are orientated in a perpendicular manner with respect to each other.

However, FIG. 2 also shows that the LF antenna 14 is located in the NFC field of the NFC antenna 16, wherein the field lines associated with the NFC field bend over the LF antenna 14. Hence, the LF antenna 14 is located in the NFC field of the NFC antenna 16, but the LF antenna 14 is associated with the center C of the NFC antenna 16, resulting in a minimal disturbance or rather blocking of the NFC field provided by the NFC antenna 16.

Hence, the strength of the NFC field is reduced by the LF antenna 14 only in a minimal manner, thereby ensuring that the NFC field has a substantially homogenous strength distribution along a length side of the vehicle door handle 10 that corresponds to the long side of the NFC antenna 16.

Generally, the NFC antenna 16 provides a NFC field that covers an area that is associated with the dimensions of the vehicle door handle 10, thereby maximizing the performance of the NFC antenna 16.

The operative area of the NFC antenna 16 is maximized since the NFC antenna 16 extends over the entire circuit board 18.

Hence, a NFC tag 28 is enabled to interact with the NFC antenna 16 along the entire size of the vehicle door handle 10 as illustrated in FIG. 2.

Figure 3:
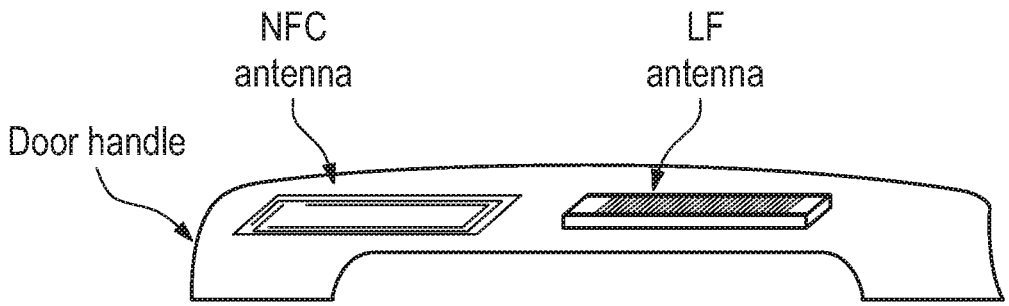
FIG. 3 shows a vehicle door handle according to the prior art.
Figure 4:
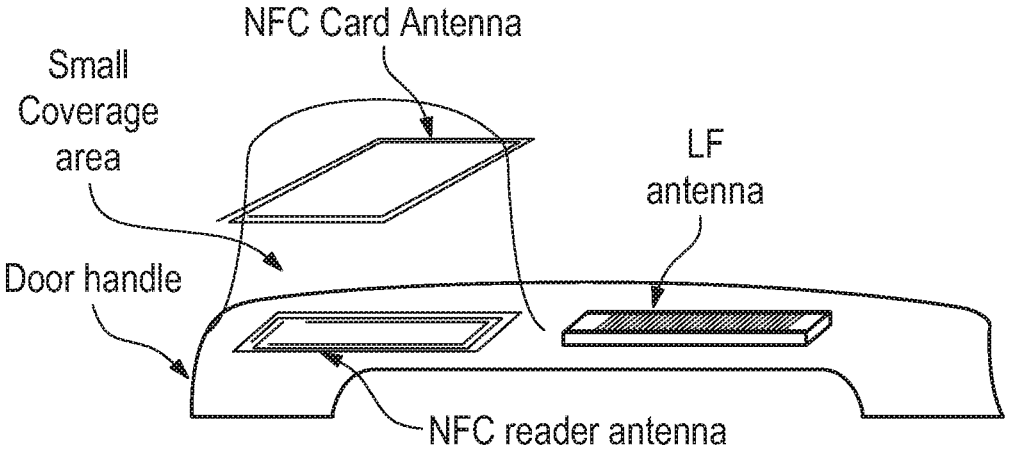
FIG. 4 shows the vehicle door handle of FIG. 3 in operation.

In FIGS. 3 and 4, a vehicle door handle according to the state of the art is shown in which the NFC antenna is placed side-by-side with respect to the LF antenna, thereby causing a relative small NFC communication coverage compared to the NFC communication coverage provided by the vehicle door handle 10 according to the present disclosure as shown in FIGS. 1 and 2.

Figure 5:
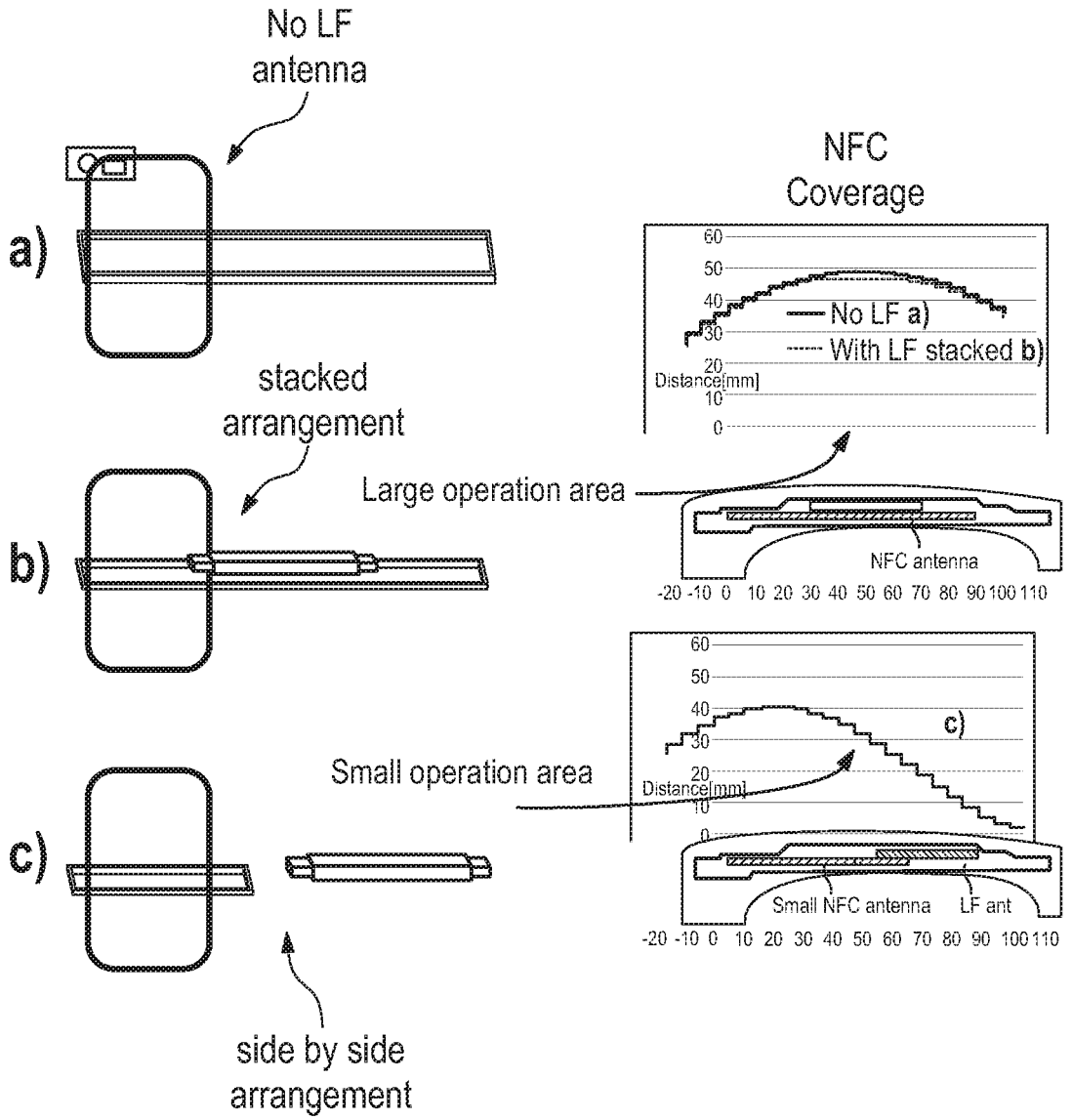
FIG. 5 shows an overview illustrating different NFC antenna arrangements and the respective coverage of the NFC antenna

In FIG. 5, another overview is provided that shows the NFC communication coverage for different designs of the antenna arrangement.

In FIG. 5, "a)" labels a transmitting and/or receiving device 12 that only has a NFC antenna without any LF antenna. Accordingly, the antenna arrangement solely consists of the NFC antenna, thereby providing best NFC coverage as no LF antenna is provided that may disturb the NFC field.

Further, "b)" labels the antenna arrangement 26 shown in FIGS. 1 and 2, namely the stacked antenna arrangement 26 in which the LF antenna 14 is located on top of the NFC antenna 16, particularly its center C, such that the edges of the NFC antenna 16 are not covered. As discussed above, the field lines of the NFC field bend over the LF antenna 14, thereby closing the NFC field in proximity of the LF antenna 14 even though the LF antenna 14 is located on the NFC antenna 16. In fact, the field strength is minimally reduced by the separately formed LF antenna 14, but a homogenous strength distribution along the length side of the vehicle door handle 10 is ensured.

Moreover, "c)" labels the antenna arrangement known in the state of the art, namely according to a side-by-side arrangement of the antennas as shown in FIGS. 3 and 4.

Obviously, the antenna arrangement 26 shown in FIGS. 1 and 2, which is labelled by "b)", provides better NFC communication coverage compared to the one known in the state of the art that is labelled by "c)" since the NFC communication coverage extends along the entire length of the vehicle door handle 10.

Moreover, the antenna arrangement 26 shown in FIGS. 1 and 2, which is labelled by "b)", provides more functionality compared to the one labelled with "a)", as it simultaneously ensures both communication functionalities, namely LF communication techniques as well as NFC communication techniques since the antenna arrangement 26 comprises the LF antenna 14 as well as the NFC antenna 16.

The overview of FIG. 5 illustrates that the entire field strength of the antenna arrangement 26 shown in FIGS. 1 and 2 is only minimally reduced compared to the one labelled with "a)" even though the additional LF antenna 14 is provided that is placed on the NFC antenna 16. Moreover, FIG. 5 shows that the NFC field has a substantially homogenous strength distribution along the length side of the vehicle door handle 10 since the strength of the middle or rather center portion of the NFC field is minimally reduced rather than the outer areas, resulting in a more homogenous strength distribution compared to a typical radiation pattern of a single antenna as shown in the arrangement labelled with "a)".

Accordingly, the vehicle door handle 10 shown in FIGS. 1 and 2 provides two separate antennas 14, 16 for two different communication functionalities, namely access tool functionality and passive entry functionality. Both antennas 14, 16 are located with respect to each other within the vehicle door handle 10 such that they ensure best performance and largest coverage, thereby improving the characteristics of the entire antenna arrangement 26.

The invention claimed is:

1. A vehicle door handle for a motor vehicle, the vehicle door handle comprising:

an integrated transmitting and/or receiving device which includes an LF antenna and a separately formed NFC antenna, the NFC antenna having a plurality of windings provided on a circuit board, the LF antenna having a plurality of coils wound around a core material formed separately from the circuit board, the NFC antenna encompassing a projection of the LF antenna on the circuit board, wherein the LF antenna is assigned to a center of the NFC antenna, and wherein the LF antenna is assigned to a center axis of the windings of the NFC antenna, and wherein the circuit board provides two opposite sides, wherein the LF antenna and the NFC antenna are assigned to the same side of the circuit board that faces away from a vehicle door when a vehicle door handle is mounted on a vehicle door.

2. The vehicle door handle according to claim 1, wherein the LF antenna and the NFC antenna are arranged one above the other with respect to the circuit board.

3. The vehicle door handle according to claim 1, wherein the LF antenna and the NFC antenna are stacked on top of each other.

4. The vehicle door handle according to claim 1, wherein the NFC antenna and the circuit board together form a module formed in one-piece.

5. The vehicle door handle according to claim 1, wherein the LF antenna is placed on the separately formed NFC antenna.

6. The vehicle door handle according to claim 4, wherein the LF antenna is placed on the separately formed module.

7. The vehicle door handle according to claim 1, wherein the LF antenna and the NFC antenna are arranged perpendicular to each other.

8. The vehicle door handle according to claim 1, wherein field lines of a LF field associated with the LF antenna and field lines of a NFC field associated with the NFC antenna intersect each other perpendicularly.

9. The vehicle door handle according to claim 1, wherein the NFC antenna provides a NFC field that covers an area that is associated with the dimensions of the vehicle door handle.

10. The vehicle door handle according to claim 9, wherein the LF antenna is located in the NFC field of the NFC antenna, wherein the field lines associated with the NFC field bend over the LF antenna.

11. The vehicle door handle according to claim 10, wherein a strength of the NFC field is reduced by the LF antenna in a minimal manner.

12. The vehicle door handle according to claim 9, wherein the NFC field has a substantially homogenous strength distribution along a length side of the vehicle door handle.

13. The vehicle door handle according to claim 1, wherein the NFC antenna extends over the entire circuit board.

14. A vehicle door handle for a motor vehicle, the vehicle door handle comprising:

an integrated transmitting and/or receiving device which comprises an LF antenna and a separately formed NFC antenna, the NFC antenna having a plurality of windings provided on a circuit board, the LF antenna having a plurality of coils wound around a core material formed separately from the circuit board, the NFC antenna encompassing a projection of the LF antenna on the circuit board, wherein the circuit board provides two opposite sides, wherein the NFC antenna is disposed on one side of the circuit board, wherein said side of the circuit board faces away from a vehicle door when the vehicle door handle is mounted on the vehicle door, and wherein the LF antenna is disposed over the NFC antenna such that the LF antenna and the NFC antenna are stacked on top of each other.

15. A vehicle door handle for a motor vehicle, the vehicle door handle comprising:

an integrated transmitting and/or receiving device which comprises an LF antenna and a separately formed NFC antenna, the NFC antenna having a plurality of windings provided on a circuit board, the LF antenna having a plurality of coils wound around a core material formed separately from the circuit board, the NFC antenna encompassing a projection of the LF antenna on the circuit board, wherein the NFC antenna is disposed on a side of the circuit board and the LF antenna is located at the same side of the circuit board such that the LF antenna and the NFC antenna are assigned to the same side of the circuit board, and wherein said side of the circuit board faces away from a vehicle door when the vehicle door handle is mounted on the vehicle door.

* * * * *